United States Patent [19]

Imamura et al.

[11] 4,297,934

[45] Nov. 3, 1981

[54] DISPLAY DEVICE FOR AUTOMATIC RHYTHM PERFORMANCE APPARATUS

[75] Inventors: Akio Imamura; Akiyoshi Oya, both of Hamamatsu, Japan

[73] Assignee: Nippon Gakki Seizo Kabushiki Kaisha, Hamamatsu, Japan

[21] Appl. No.: 142,757

[22] Filed: Apr. 22, 1980

[30] Foreign Application Priority Data

Apr. 24, 1979 [JP] Japan ..... 54/55656[U]

[51] Int. Cl.[3] ..... G10F 1/00

[52] U.S. Cl. ..... 84/1.03; 84/464 R; 84/DIG. 12

[58] Field of Search ..... 84/1.03, DIG. 12, 464

[56] References Cited

U.S. PATENT DOCUMENTS 4,012,979 3/1977 Wemekamp ..... 84/464
4,014,167 3/1977 Hasegawa et al. ..... 84/464
4,033,220 7/1977 Shibahara ..... 84/1.03
4,089,246 5/1978 Kooker ..... 84/1.03
4,218,874 8/1980 Ishida et al. ..... 84/1.03

*Primary Examiner*—R. L. Moses
*Assistant Examiner*—Forester W. Isen
*Attorney, Agent, or Firm*—Spensley, Horn, Jubas & Lubitz

[57] ABSTRACT

A display device for an automatic rhythm performance apparatus comprises a common display unit which selectively displays tempo and rhythm advancement of the automatic rhythm performance. For this purpose, the device has a selector for selecting the display contents so that the display of tempo is performed by numerical value before the rhythm starts, and the display of the rhythm advancement is performed by the number of measures, the number of beats and a demarcating mark between them after the rhythm starts.

6 Claims, 5 Drawing Figures

DISPLAY DEVICE FOR AUTOMATIC RHYTHM PERFORMANCE APPARATUS

BACKGROUND AND SUMMARY OF THE INVENTION

This invention relates to a display device for an automatic rhythm performance apparatus capable of displaying a tempo of a rhythm to be auto-played and a state of rhythm advancement.

In the art of an automatic rhythm performance apparatus there has been known a device for displaying a tempo of an auto-played rhythm. Also known is an automatic rhythm apparatus provided with a device for displaying the number of measures representing progress of a rhythm. The tempo and the rhythm advancement may be displayed in numerical value.

The numerical display of tempo, however, is necessary especially when the tempo of a rhythm is adjusted before the start of the automatic rhythm performance and such numerical display of tempo seldom is needed during playing of the automatic rhythm. On the other hand, numerical display of the rhythm advancement is only required during playing of the automatic rhythm.

It is, therefore, an object of the present invention to provide a display device for an automatic rhythm performance apparatus capable of selectively displaying tempo and a state of a rhythm advancement by a common display unit. The design of the whole apparatus is thereby simplified and display function of the display device is improved.

According to the invention, there is provided a common display unit and a tempo of a rhythm to be auto-played is numerically displayed by this display unit before start of running of the rhythm whereas a state of the rhythm advancement is numerically displayed by the same display unit during running of the rhythm. The numerical display of the rhythm advancement is preferably made by the number of measures and the number of beats which have advanced in the automatic rhythm performance. For displaying the rhythm advancement, the least significant digit, for example, of total three digits of the display unit is used for displaying the number of beats whereas the other two digits are used for the number of measures. A demarcating display may be provided between the least significant digit and the adjacent digit for distinquishing the measure number and the beat number.

These and other features of the invention will become apparent from description made hereinbelow in conjunction with the accompanying drawings.

DESCRIPTION OF A PREFERRED EMBODIMENT

Figure 1:
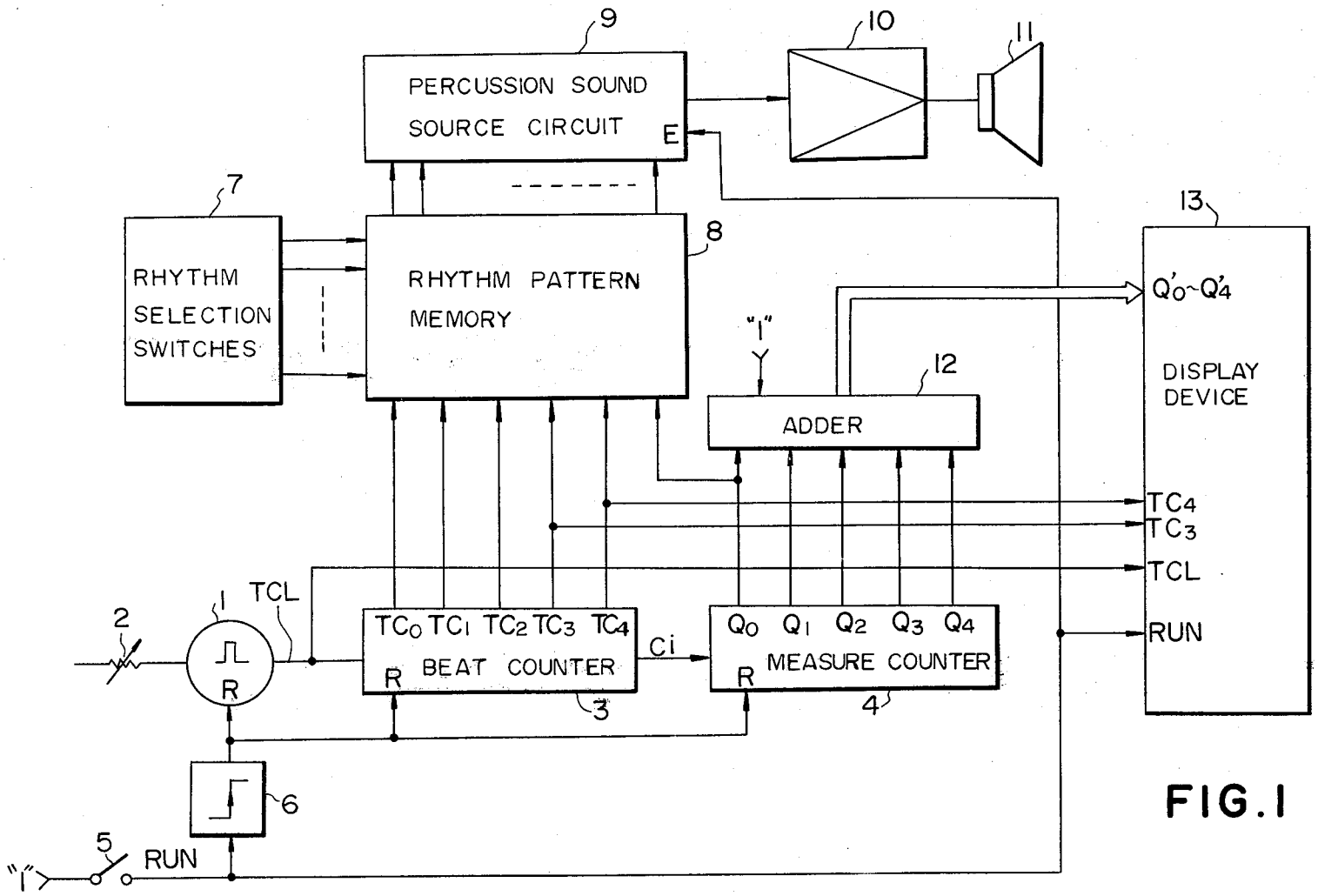
FIG. 1 is a schematic block diagram showing an embodiment of an automatic rhythm performance apparatus incorporating a display device according to the invention.

Referring first to FIG. 1, a preferred embodiment of a display device according to the invention will be described. An automatic rhythm performance apparatus to which the invention is applied may be either an independent rhythm apparatus or a rhythm device incorporated in such an electronic musical instrument as an electronic organ.

A tempo generator 1 generates a temp clock pulse TCL which determines the tempo of a rhythm produced by the automatic rhythm performance apparatus. The frequency of this tempo pulse TCL is variably controlled by adjusting a variable resistor 2.

A beat counter 3 of five bits is driven by the tempo pulse TCL generated by the tempo generator 1 and a measure counter 4 of five bits is driven by a carry signal $C_1$ of the beat counter 3. Contents of the most significant bit and the second significant bit of the beat counter 3 are used to display the number of beats which has advanced in each measure whereas contents of the measure counter 4 are used to display the number of measures which has advanced. More particularly, if it is assumed that each tempo pulse corresponds to one thirty-second notes and that the counter 3 has modulo of 32, then the outputs of the most significant two bits $TC_3$ and $TC_4$ designates four beats with a quarter note being one beat. Suitably varying the modulo of the counter 3, such other beats as derived from duple and triple meters are also designated by the above two bit outputs. This technique itself, however, is known in the field of automatic rhythm devices and will not be described in further detail. Parallel bit outputs $TC_0$ through $TC_4$ of the beat counter 3 and the least significant bit output $Q_0$ of the measure counter 4 are applied to a rhythm pattern memory 8 as a dynamic address designation signal.

The rhythm pattern memory 8 stores rhythm patterns of two measures with respect to respective rhythms. By turning on one of rhythm selection switches 7, a rhythm pattern of a selected rhythm is read out in accordance with the dynamic address designation signal $TC_0$–$Q_0$ outputted from the beat counter 3 and the measure counter 4. As the dynamic address designation signal $TC_0$–$Q_0$ of the rhythm pattern memory 8 the least significant bit output $Q_0$ of the measure counter 4 is employed besides the parallel bit outputs $TC_0$–$TC_4$ of the beat counter 3 for the reason that a rhythm pattern for two measures for each rhythm are stored in the rhythm pattern memory 8. By virtue of this arrangement, a former one measure of the rhythm pattern is read out when the least significant bit output $Q_0$ of the measure counter 4 is "0" whereas a latter one measure of the rhythm pattern is read out when the output $Q_0$ is "1". If the rhythm pattern memory 8 is so constructed that it stores rhythm patterns for one measure, the parallel bit outputs $TC_0$–$TC_4$ of the beat counter 3 only are enough as the dynamic address designation signal. The rhythm pattern (i.e., rhythm pattern pulses) read from the rhythm pattern memory 8 is applied to a percussion sound source circuit 9.

The percussion sound source circuit 9 may be a known one and comprise sound source circuits corresponding to tone colors of various percussion instruments. Sound source signals generated by these second source circuits are gate-controlled in accordance with the rhythm pattern pulse read from the rhythm pattern memory 8 thereby to form a musical sound signal led to an amplifier 10 and a loud speaker 11.

Assuming now that a rhythm start switch 5 is in an "off" state, a rhythm running signal RUN is "0". Since this rhythm running signal RUN controls an enable terminal E of the percussion sound source circuit 9, the percussion sound source circuit 9 is in an inoperable state. Accordingly, even if the beat counter 3 and the measure counter 4 are operated in response to the tempo pulse TCL generated by the tempo generator 1 and the rhythm pattern pulse is generated by the rhythm pattern memory 8, the percussion sound source circuit 9 does not produce a musical sound signal representing a rhythm sound so that no rhythm sound is sounded from the speaker 11.

Figure 2:
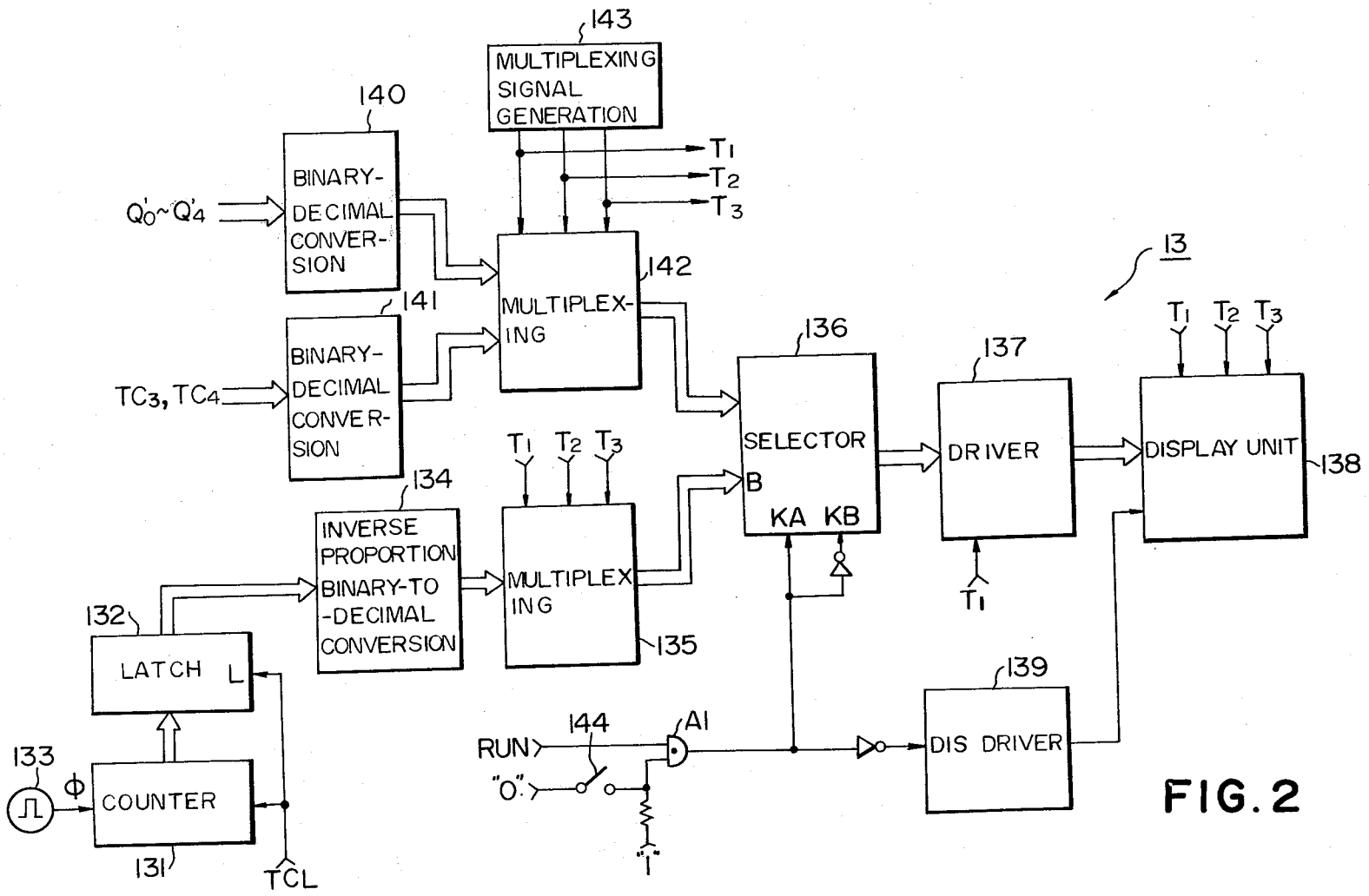
FIG. 2 is a block diagram showing the display device in detail.

During this time, the tempo is numerically displayed by a display device 13 which is shown in detail in FIG. 2. The tempo pulse TCL generated by the tempo generator 1 is applied to a reset terminal R of a counter 131 and also to a load control terminal L of a latch 132. The counter 131 is provided at its count input with a clock pulse $\phi$ generated by an oscillator 133 and is driven by this clock pulse $\phi$. The frequency of this clock pulse $\phi$ is set to be sufficiently higher than the frequency of the tempo pulse TCL. The counter 131 is first reset by the tempo pulse TCL and subsequently counts the clock pulse $\phi$ generated by the oscillator 133 until arrival of a next tempo pulse TCL. Upon arrival of the next tempo pulse TCL, the count of the counter 131 is loaded in the latch 132. Simultaneously, the counter 131 is reset so that the counter 131 resumes counting of the clock pulse $\phi$ from 0 and the same operation is repeated thereafter. Accordingly, contents of the latch 132 corresponding to the frequency of the tempo pulse TCL. In other words, the value of the content latched by the latch 132 is inversely proportional to the frequency of the tempo pulse TCL. The contents of the latch 132 are applied to an inverse proportion binary-to-decimal conversion circuit 134.

The inverse proportion binary-to-decimal conversion circuit 134 is composed, for example, of a read-only memory (ROM) and stores decimal signals which are read out to be in inverse proportion to output values of the latch 132 with the outputs of the latch 132 being used as address designation signals. Thus, the inverse proportion binary-to-decimal conversion circuit 134 produces decimal signals which are in proportion to the frequency of the tempo pulse TCL (i.e., tempo). These signals are supplied to a multiplexing circuit 135.

The multiplexing circuit 135 receives multiplexing signals $T_1$, $T_2$ and $T_3$ from a multiplexing signal generation circuit 143 and the decimal signals applied from the inverse proportion binary-to-decimal conversion circuit 134 are time division multiplexed digit by digit in synchronism with the respective multiplexing signals $T_1$, $T_2$ and $T_3$. The multiplexing signal $T_1$ corresponds to the timing of the most significant digit (the order of 100) of a display unit 138, the multiplexing signal $T_2$ corresponds to the timing of the second significant digit (the order of 10) and the multiplexing signal $T_3$ corresponds to the timing of the least significant digit (the order of 1). The signal representing the tempo which has been time division multiplexed by the multiplexing circuit 135 is applied to the input B of a selector 136.

Figure 3A:
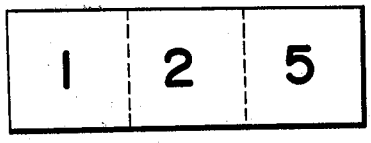
FIGS. 3(*a*), 3(*b*) and 3(*c*) are diagrams showing examples of displays by a display unit.
Figure 3B:
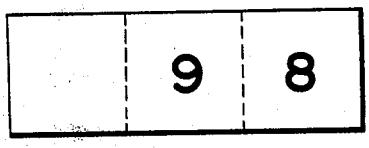
Figure 3C:
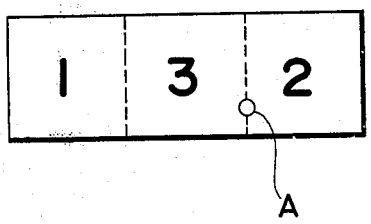

When the rhythm start switch 5 (FIG. 1) is in an off state, the rhythm running signal RUN is "0". An AND gate $A_1$ is not enabled, and the selector 136 receives a signal "1" at its input B selection terminal KB, thereby selecting the signal representing the tempo applied to the input B thereof. The signal representing the tempo selected by the selector 136 is applied to the display unit 138 through a display unit driver 137. The display unit 138 is composed of a light emitting diode display unit of three digits. In the display unit 138, the applied signals representing the tempo are allotted to the light emitting diodes of the respective digits in accordance with the multiplexing signals $T_1$–$T_3$ generated from the multiplexing signal generation circuit 143, the tempo being shown by the figure of the three digits. An example of the numerical display of the tempo is shown in FIG. 3(*a*). This display is equivalent in the meaning to a symbol ♩ =125.

When the most significant digit of the display unit is "0", the multiplexing signal $T_1$ applied to the driver 137 is used for prohibiting the display of "0". More specifically, when contents of the most significant digit, i.e. contents allotted at the timing of the multiplexing signal $T_1$, are "0", the display unit driver 137 prohibits supply of a signal allotted at the timing of the multiplexing signal $T_1$ to the display unit 138. Accordingly, the "0" contents of the most significant digit of the display unit 138 are not displayed. An example of this case is shown in FIG. 3(*b*).

The output of the AND gate $A_1$ is inverted and applied to a disable terminal DIS of a point displaying light emitting diode driver 139. The point displaying light emitting diode driver 139 therefore is disabled when the switch 5 is off.

In this state, the player can adjust the variable resistor 2 (FIG. 1), watching variation in the numerical display of the tempo in the display unit 138, and adjust the tempo by changing the frequency of the tempo pulse TCL generated by the tempo generator 1.

Upon turning on of the rhythm start switch 5, the rhythm running signal RUN rises from "0" to "1". This rhythm running signal RUN is differentiated by a differentiation circuit 6 when it rises. The differentiated pulse outputted from the differentiation circuit 6 is applied to reset terminals R of the tempo generator 1, the beat counter 3 and the measure counter 4 for resetting the tempo generator 1, the beat counter 3 and the measure counter 4 to their initial states. The beat counter 3 therefore starts counting from the first beat and the measure counter 4 starts counting from the first measure.

The rhythm running signal RUN is applied also to an enable terminal E of the percussion sound source circuit 9 to enable this circuit 9. The percussion sound source circuit 9 thereupon produces musical sound signals representing the rhythm sound in accordance with the rhythm pattern pulse read from the rhythm pattern memory 8. The musical sound signal is applied to the speaker 11 through the amplifier 10 and the rhythm performance thereby is started.

At this time, the display device 13 displays the number of measures and the number of beats which have progressed. Parallel bit outputs $Q_0$–$Q_4$ of the measure counter 4 corresponding to the number of measures are applied to an adder 12. The adder 12 adds "1" to the signals $Q_0$–$Q_4$ outputted from the measure counter 4 and provides a sum signal $Q_0'$–$Q_4'$ to the display device 13. The addition of "1" by the adder 12 is necessary because the measure counter 4 starts counting from an initial state in which contents of all bits are "0" so that the count of the measure counter 4 is smaller by one than the number of measures which has actually progressed.

The outputs $TC_3$ and $TC_4$ of the most significant digit and the second significant digit of the beat counter 3 corresponding to the beat which has progressed are applied to the display device 13 without any modification.

In the display device 13 (FIG. 2), the signals $Q_0'$-$Q_4'$ representing the number of measures which has progressed and the signals $TC_3$ and $TC_4$ representing the number of beats which has progressed are applied to binary-to-decimal conversion circuits 140 and 141 where these signals are converted to signals displaying a decimal number. These signals thereafter are applied to a multiplexing circuit 142. The multiplexing circuit 142 receives the multiplexing signals $T_1$, $T_2$ and $T_3$ generated by the multiplexing signal generation circuit 143. In the multiplexing circuit 142, the decimal signals representing the number of measures applied from the binary-to-decimal conversion circuit 140 are allotted at the timing of the multiplexing signals $T_1$ and $T_2$ whereas the decimal signals representing the number of beats applied from the binary-to-decimal conversion circuit 141 are allotted at the timing of the multiplexing signal $T_3$ whereby time division multiplexed signals representing the number of measures and the number of beats which have progressed in the automatic rhythm performance are formed. The time division multiplexed signals are supplied to an input A of the selector 136.

When the rhythm running signal RUN is "1" and the AND gate $A_1$ thereby is enabled, the AND gate $A_1$ produces a signal "1" if a tempo display command switch 144 is off. This signal "1" is applied to an input A selection terminal KA of the selector 136 so that the selector 136 selects a signal applied to the input A thereof. The signal representing the number of measures and the number of beats and selected by the selector 136 is applied to the display unit 138 through the driver 137 and the number of measures and the number of beats are thereby indicated.

Since the signal representing the number of measures is allotted by the multiplexing signals $T_1$ and $T_2$, the most significant digit and the second significant digit of the display unit 138 are used for displaying this signal, whereas the signal representing the beat which is allotted by the multiplexing signal $T_3$ is displayed by using the least significant digit of the display unit 138.

If the output of the AND gate $A_1$ is turned to "1", the point displaying light emitting diode driver 139 is enabled to apply a point displaying light emitting diode drive signal to the display unit 138. In the display unit 138, the point displaying light emitting diode (not shown) is provided between the least significant digit and the adjacent digit. This point displaying light emitting diode is provided not for displaying an ordinary decimal point but for distinguishing the number of measures and the number of beats. Alternatively stated, the point displaying light emitting diode is lighted in response to the point displaying light emitting diode drive signal from the driver 139 and thereby distinguishes the number of measures from the number of beats.

An example of display by the display unit 138 is shown in FIG. 3(*c*). In FIG. 3(*c*), the numeral "13" represents the number of measures and the numeral "2" the number of beats. The point A is displayed by lighting of the point display light emitting diode.

In this embodiment, tempo can be numerically displayed in the display unit 138 even during running of the rhythm by turning on the tempo display command switch 144. If the tempo display command switch 144 is turned on, a signal "0" is applied to the AND gate $A_1$ to disable it. This causes a signal "1" to be applied to the input B selection terminal KB of the selector 136 so that the selector 136 selects a signal applied to the input B thereof. On the other hand, the point displaying light emitting diode driver 139 is disabled by the output "0" of the AND gate $A_1$.

Accordingly, the numerical signal representing the tempo which is formed by the generator 133, counter 131, latch 132, inverse proportion binary-to-decimal conversion circuit 134 and multiplexing circuit 135 is applied to the display unit 138 through the display unit driver 137 whereby the tempo is displayed as shown in FIG. 3(*a*) or FIG. 3(*b*).

According to the present invention, running of tempo and rhythm can be numerically displayed by a single common display unit. This contributes to simplification of design of the display device of the automatic rhythm performance apparatus. Further, the contents of the display are automatically changed so that tempo is displayed when rhythm is stopped and the state of rhythm advancement is displayed during running of the rhythm and, accordingly, the display unit displays only data which the player needs in the respective states.

What is claimed is:

1. A display device for an automatic rhythm performance apparatus of the type having a tempo generator which generates a sequence of tempo pulses, and having a switch that is actuated to initiate the running of a rhythm performance, comprising:

means for forming a first digital display signal representing a tempo corresponding to said tempo pulses generated by said tempo generator;

means for forming a second digital display signal representing a rhythm advancement in accordance with outputs of a counter which is driven by said tempo pulses;

a digital display unit; and display signal selecting means for selectively carrying out a switching operation so that, under the condition that rhythm performance is stopped, said first digital display signal is applied to said display unit and, under the condition that said rhythm performance is running, said second digital display signal is applied to said display unit.

2. A device as claimed in claim 1, in which said second digital display signal consists of an advancement measure digital display signal representing the number of measures which have elapsed in the automatic rhythm performance and an advancement beat digital display signal representing the number of beats which have elapsed in each measure, said number of elapsed measures and number of elasped beats being simultaneously, digitally displayed on said display unit.

3. A device as claimed in claim 2, in which said display unit comprises means for displaying a distinguishing mark for distinguishing the displays of said number of elapsed measures and said number of elapsed beats from each other.

4. A device as claimed in claim 1, in which said display signal selecting means comprising a tempo display forcing switch, for carrying out switching selection so that, under the condition that said tempo display forcing switch is turned on, said first digital display signal is applied to said display unit.

5. A display device for an automatic rhythm performance apparatus comprising:

a tempo pulse generator for generating a tempo pulse which determines a tempo for a rhythm performance of the automatic rhythm performance apparatus;

means responsive to said tempo pulse for producing a first display signal representing said tempo;

counter means driven by said tempo pulse to produce a count signal which is proportional to progress of the rhythm performance after the rhythm performance is started;

means responsive to said count signal for producing a second display signal representing said progress of the rhythm performance;

display means responsive to either one of said first and second display signals for displaying an amount corresponding to said one display signal; and selection means for selectively applying one of said first and second display signals to said display means whereby said display means is commonly used for displaying said first and second display signals.

6. A device as claimed in claim 5, in which said selection means comprises detection means for detecting the start of said rhythm performance, and a selector controlled by said detection means so that said second display signal is applied to said display means after the rhythm performance is started.

* * * * *